US005284187A

United States Patent [19]

Schmit

[11] Patent Number: 5,284,187

[45] Date of Patent: Feb. 8, 1994

[54] METHOD AND DEVICE FOR TREATING POWDER COAL IN A SOLID-FUEL INJECTION INSTALLATION

[75] Inventor: Louis Schmit, Luxembourg, Luxembourg

[73] Assignee: Paul Wurth S.A., Luxembourg

[21] Appl. No.: 853,627

[22] Filed: Mar. 19, 1992

[30] Foreign Application Priority Data

Mar. 20, 1991 [LU] Luxembourg ..... 87 910

[51] Int. Cl.[5] ..... B65B 1/04

[52] U.S. Cl. ..... 141/1; 141/5; 141/67; 141/248; 141/45; 141/95; 141/192; 141/286; 141/290; 44/626; 414/160; 414/287; 48/86 R; 48/210; 48/DIG. 4

[58] Field of Search ..... 44/620, 621, 626; 141/1, 4, 5, 7, 11, 44, 45, 47, 49, 50, 67, 70, 85, 89, 91, 94, 95, 192, 248, 286, 290, 301, 302, 307; 414/160, 161, 287, 288, 291, 292, 299; 209/146; 406/3, 30; 110/101 C, 101 CF, 105, 347; 48/86 R, 197 R, 210, DIG. 4, DIG. 7

[56] References Cited

U.S. PATENT DOCUMENTS 3,775,071 11/1973 Hoffert et al. ..... 48/210
3,994,701 11/1976 Schweimanns ..... 110/105 X
4,153,427 5/1979 Bissett et al. ..... 48/86 R
4,593,727 6/1986 Ulveling ..... 141/5
4,702,288 10/1987 Ulveling et al. ..... 141/67

*Primary Examiner*—J. Casimer Jacyna
*Attorney, Agent, or Firm*—Fishman, Dionne & Cantor

[57] ABSTRACT

The present invention relates to a method for treating powdered coal in a solid-fuel injection installation. Such an installation comprises a powdered coal storage bunker, at least one lock connected to the circuit for pneumatically transporting the coal, at least one filtering screen connected between each lock and the bunker, a pressurized inert-gas source for pressurizing each lock and forming the pneumatically propelled flow of the coal and a circuit for pressure-equalizing and depressurizing each lock through a filter. According to the present invention, the major portion of the inert gas for depressurizing each lock is subjected to a filtering operation before being injected through the bottom of the storage bunker into the mass of coal and being discharged through a filter at the top of the bunker. The residual portion of the inert depressurizing gas is shunted directly towards the top of the storage bunker. The present invention also relates to a device for implementing the method.

19 Claims, 1 Drawing Sheet

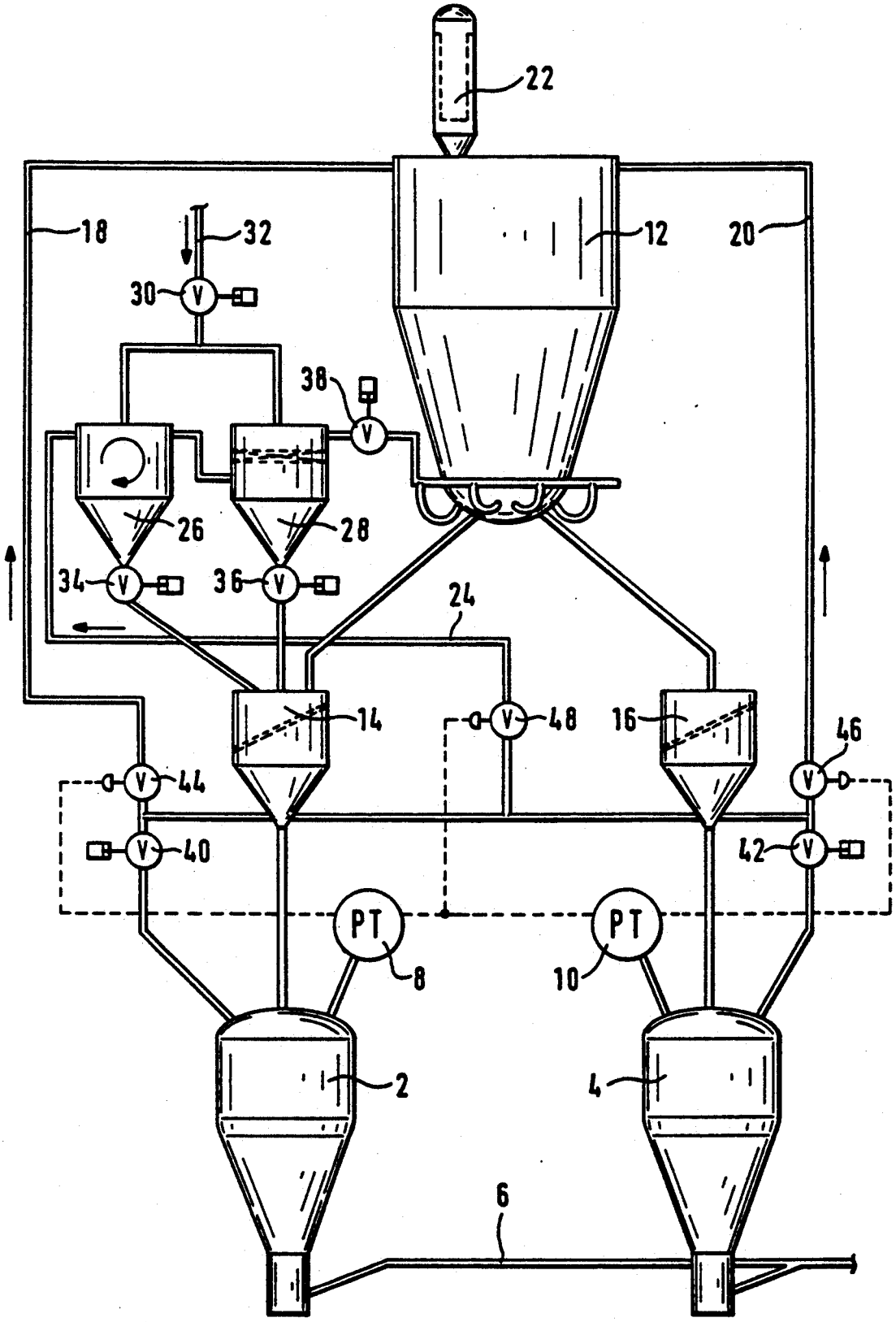
22
12
18
20
32
30
V
38
V
26
28
34
V
36
V
24
14
V
48
16
46
V
44
V
V
40
42
V
PT
PT
8
10
2
4
6

METHOD AND DEVICE FOR TREATING POWDER COAL IN A SOLID-FUEL INJECTION INSTALLATION

BACKGROUND OF THE INVENTION

The present invention relates to a method for treating powdered coal in an installation for injecting solid fuels, comprising a powdered coal storage bunker, at least one lock connected to the circuit for pneumatically transporting the coal, at least one filtering screen connected between each lock and the bunker, a pressurized inert-gas source for pressurizing each lock and forming the pneumatically propelled flow of the coal and a circuit for pressure-equalizing and depressurizing each lock through a filter. The invention also relates to a device for the implementation of this method.

An installation of this general kind is described in U.S. Pat. No. 4,702,288, which is incorporated herein by reference. The coal used in this kind of installation is generally delivered loose and is broken up, ground and dried in place. The grinding is carried out, for example, in a vertical grinding mill in which the coal is crushed on a rotary milling track by milling rollers. The coal powder is entrained by drying gases into a separator, from which it is dumped into the storage bunker of the installation for injection into a furnace.

The relative humidity poses a certain number of problems in the storage bunker. In fact, because of the drying of the coal, the drying gas accumulates a large quantity of water vapor which, as the bunker cools, is condensed above the mass and is responsible for an agglomeration and for an encrustation of the coal powder.

Moreover, because of heat exchanges and thermal equilibria within the mass of the coal powder, the coal powder "transpires", which also creates a gaseous environment rich in water vapor within the interstices of the mass of coal. This water vapor within the mass of coal is entrained out of the bunker into the filter screen where, by condensing, it creates the risk of clogging up the screening elements.

SUMMARY OF THE INVENTION

The present invention provides a novel method and a novel device in which the risks of condensation of water vapor are substantially reduced. In accordance with the present invention, the major portion of the inert gas for depressurizing each lock is subjected to a filtering operation before being injected through the bottom of the storage bunker into the mass of coal. The gas is then discharged through a filter at the top of the bunker, above the coal level, and the residual portion of the inert depressurizing gas is shunted directly towards the top of the storage bunker.

The filtering operation for the inert gas preferably comprises a dynamic filtration phase and a static filtration phase. The filtering means may be purged and cleaned with inert gas which, at the outlet of the filtering means, is directed through the screen or screens with the coal powder into the lock or locks while they are being filled.

Heretofore, up to now the pressurized inert gas emanating from the depressurizing of the locks was lost, insofar as it was injected into the top of the bunker only with the purpose of being discharged via the filter of the bunker; and this injected inert gas has, prior to the present invention, created the additional risk of cooling the environment above the mass of coal and aggravating the tendency for condensation. The present invention advantageously profits from the availability of this fairly dry and inert gas in order to improve the thermal and hygrometric conditions in this bunker, this being the case both within and above the mass of coal. In fact, by injecting this pressurized inert gas into the bottom of the bunker, a multiple beneficial effect is produced.

The water vapor originally present within the interstices of the mass and subsequently above the coal level is purged by forcing the gas to traverse the mass of coal from the bottom upwards. As a result of the thermal exchanges, the inert gas cools the coal, which reduces the "transpiration" of the coal and the heating of the gas reduces the risks of condensation of the vapor.

The traversing of the gas within the mass of the coal powder also has a beneficial effect on the consistency of the coal, by virtue of its loosening action.

When the pressure of the gas falls to a level that is insufficient to purge the mass of coal in the bunker, the gas is automatically shunted towards the top of the bunker until the completion of the pressure equalization phase in the locks.

The device for implementing the present invention includes a circuit for pressure-equalizing and for depressurizing each lock, that circuit comprising a primary circuit connecting the top of the storage bunker to each lock and a secondary circuit connecting the bottom of the storage bunker, through a filter unit, to each lock. The filter unit may comprise a cyclone and a filter plate. Both the cyclone and the filter plate may be connected, on the one hand, to at least one screen and, on the other hand, to a circuit of inert gas for cleaning.

Other special features and characteristics will be appreciated and understood by those skilled in the art from the following description of an embodiment of the invention.

BRIEF DESCRIPTION OF THE DRAWING

The single FIGURE of the drawings illustrates a block diagram of an installation in accordance with the present invention.

DESCRIPTION OF THE PREFERRED EMBODIMENT

Referring to the drawing, two locks identified as items 2 and 4 operate alternately in order to sluice the powder coal into a pneumatic transport pipe 6 under the action of an inert propulsion gas injected, under pressure, into each of the locks 2 and 4 from one or two pressurized gas sources, not shown, the pressure of which is measured and monitored by pressure sensors 8, 10. The locks 2 and 4 are fed with coal powder from a storage bunker 12 through screens 14, 16 containing means for filtering the coal powder.

Given that the two locks 2, 4 are under the pressure of the propulsion gas when they are empty, it is necessary to depressurize them before being able to fill them. For this purpose, each of the locks 2, 4 is connected through a primary circuit 18, 20 to the top of the storage bunker 12 where ventilation is effected through a filter 22 which is located on the bunker 12.

In accordance with the present invention, each of the two locks is also connected up through a secondary circuit 24 to the bottom of the bunker 12. This secondary circuit 24 traverses a filter unit which can be constituted by a cyclone 26 and by a filter plate 28. By opening a valve 30, the cyclone 26 and the filter plate 28 may be connected to an inert-gas source 32 intended for the cleaning of the cyclone 26 and of the filter plate 28. The cyclone 27 and the filter plate 28 may also be placed into communication with one or both screens 14, 16 by the opening of valves 34, 36, which makes it possible to use the cleaning residues by conveying them into the screen 14 (and/or into the screen 16) and to make use of the pressure of the cleaning gas as a propulsion means in order to facilitate the filling of the locks 2 and 4. During the cleaning of the filter unit, the latter is disconnected from the bunker 12 by closing a valve 38.

The two locks can be connected to their depressurization circuit 18, 20, 24 via automatic closing valves 40, 42 while the control of the operation of the primary and secondary circuits is carried out, on the one hand, by means of automatic control valves 44, 46 and, on the other hand, by the automatic control valve 48 in the secondary circuit 24. These valves 44, 46, 48 are valves whose opening is controlled automatically as a function of the pressure detected by the sensors 8 or 10 in order to ensure a specified and constant flow rate.

The operation of the apparatus described above will now be described. It will be assumed that the lock 4 is in the process of being emptied of its contents through the pneumatic transport pipe. While the lock 4 is emptied, the lock 2 may be filled but, in order to be able to fill lock 2, it is necessary first of all to depressurize lock 2 given that after having been emptied it is under a pressure corresponding to the pressure of its gas source. In accordance with the present invention, the depressurization is first of all carried out through the secondary circuit 24 under the control of the control valve 48 and through the open valve 40, the control valve 44 being held in the closed position under the command of the pressure sensor 8. The coal powder remnants entrained by the gas into the secondary circuit 24 are, in part, deposited into the cyclone 26 and, in part, retained by the filter plate 28, whereas the inert gas, stripped of the coal powder remnants, is injected into the bottom of bunker 12 in order to purge the water vapor therefrom. This injection is carried out through non-return screening elements, not shown, incorporated in the wall of the bunker 12 and capable of allowing the gas to pass and of retaining the coal powder. These non-return screening elements therefore prevent the powder from leaving the bunker 12 towards the circuit 24 and ensure, at the same time, a good distribution within the bunker 12 of the depressurizing gas issuing from the circuit 24.

The valve 48 is designed to automatically close when the pressure of the depressurizing gas falls below a prespecified threshold corresponding to the minimum pressure required for traversing the secondary circuit 24 and the mass of coal in the bunker 12. The valve 44 is designed to be automatically opened by the sensor 8 at this same pressure, such that the lock 2 is automatically switched from the secondary circuit 24 to the primary circuit 18 and that the residual portion of low-pressure inert gas is shunted towards the top of the bunker 12 in order to be discharged through the filter 22. When the lock 2 is completely depressurized, it is disconnected from the two circuits 18 and 24 by closing the valve 40. From this moment on, the filling of the lock with coal from bunker 12 may commence by opening valves, not shown, in the pipe connecting the lock 2 to the bunker 12.

According to another aspect of the invention, it is possible to take advantage of the time required for filling the lock 2 in order to clean the cyclone 26 and the filter plate 28 by connecting them to the inert-gas source 32 by opening the valve 30, and then closing the valve 38. The coal powder remnants entrained by the scavenging gas in the cyclone 26 and the filter plate 28 are then mixed with the powder flowing from the bunker 12 in the tank 14. When the lock 2 is full it may be disconnected from the intermediate tank 14 and connected to the pneumatic transport pipe 6, whereas the empty lock 4 undergoes the depressurizing and filling operations as described hereinabove for lock 2.

What is claimed is:

1. A method for treating powdered coal comprising the steps of:
   (a) storing a volume of powdered coal in a first chamber, the coal being intended for delivery to at least one second chamber;
   (b) delivering a gas under pressure to said second chamber to pressurize the coal in said second chamber:
   (c) depressurizing said second chamber by:
      (1) a first depressurizing stage including the steps of:
         (i) discharging pressurized gas from said second chamber through filter means for filtering coal powder remnants of said pressurized gas, to obtain a filtered pressurized gas;
         (ii) distributing said filtered pressurized gas through said volume of powdered coal in said first chamber; and
         (iii) venting said first chamber to atmosphere;
      (2) a second depressurizing stage including the steps of:
         (i) injecting pressurized gas from said second chamber into said first chamber above said volume of powdered coal; and
         (ii) venting said first chamber to atmosphere; and
   (d) delivering powdered coal from said first chamber to said second chamber when said second chamber is depressurized.

2. The method as in claim 1 wherein said first depressurized stage is terminated and said second depressurizing stage is commenced when the pressure within said second chamber falls to a predetermined value.

3. The method as in claim 2 including:
   subjecting the pressurized gas during said first depressurizing stage to a dynamic filtration phase and a static filtration phase.

4. The method as in claim 3 wherein said dynamic filtration phase and said static filtration phase each includes a filter; and further including the step of:
   purging each of said filters with an inert gas and delivering said inert gas and any powdered coal contained therein to said second chamber.

5. The method of claim 1 wherein two of said second chambers are employed, and the method includes the step of delivering coal from one of said second chambers to an installation for use during the depressurization of step (c) and the delivery of coal of step (d) to the other of second chambers, and the step of delivering coal from the other of said second chambers to the installation for use during the depressurization of step (c) and the delivery of coal of step (d) to said one of said second chambers.

6. The method of claim 1 wherein said first depressurizing stage includes:
   delivering pressurized gas from said second chamber to the bottom of said first chamber.

7. The method of claim 1 including means for delivering powdered coal from said first chamber to said second chamber upon depressurization of said second chamber.

8. Apparatus for the delivery of powdered coal to an installation for use, including:

a first chamber for storing a first volume of powdered coal;

at least one second chamber for containing a second volume of powdered coal, the volume of said second chamber being less than the volume of said first chamber;

inert gas means for pressurizing said second chamber to deliver powdered coal from said second chamber to an installation for use;

first depressurizing means for depressurizing said second chamber by canalizing pressurized gas from said second chamber through said first chamber to atmosphere, said first depressurizing means including:

filter means connected to said second chamber, for filtering the pressurized gas of powdered coal remnants; and distribution means connected between the filter means and the second chamber, for distributing the filtered pressurized gas through the first volume of powdered coal; and second depressurizing means for depressurizing said second chamber by canalizing pressurized gas from said second chamber through said first chamber to atmosphere, said second depressurizing means including:

conduit means connected between said first chamber and said second chamber, for discharging the pressurized gas into the first chamber above said first volume of powdered coal; and vent means connected to said first chamber, for venting said first chamber to atmosphere.

9. Apparatus as in claim 8 wherein said filter means includes:

a dynamic filter and a static filter.

10. Apparatus as in claim 9 including:

means for purging said dynamic filter and said static filter with inert gas and delivering the inert gas and any entrained coal to said secondary chamber.

11. Apparatus as in claim 8 including:

two of said second chambers;

means for delivering powdered coal from one of said second chambers to an installation for use during depressurization of and delivery of coal to the other of said second chambers; and means for delivering powdered coal from the other of said second chambers to an installation for use during depressurization of and delivery of coal to said one of said second chambers.

12. A method for treating powdered coal comprising the steps of:

(a) storing a volume of powdered coal in a first chamber, the coal being intended for delivery to at least one second chamber;

(b) delivering a gas under pressure to said second chamber to pressurize the coal in said second chamber to deliver the coal to an installation for use;

(c) depressurizing said second chamber by;

(1) a first depressurizing stage including the steps of:

(i) discharging pressurized gas from said second chamber through filter means for filtering coal powder remnants of said pressurized gas, to obtain a filtered pressurized gas;

(ii) distributing said filtered pressurized gas through said volume of powdered coal in said first chamber; and (iii) venting said first chamber to atmosphere; and (2) a second depressurizing stage including the steps of:

(i) injecting pressurized gas from said second chamber into said first chamber above said volume of powdered coal; and (ii) venting said first chamber to atmosphere.

13. The method as in claim 12 wherein said first depressurized stage is terminated and said second depressurizing stage is commenced when the pressure within said second chamber falls to a predetermined value.

14. The method as in claim 13 including:

subjecting the pressurized gas during said first depressurizing stage to a dynamic filtration phase and a static filtration phase.

15. The method as in claim 14 wherein said dynamic filtration phase and said static filtration phase each includes a filter; and further including the step of:

purging each of said filters with an inert gas and delivering said inert gas and any powdered coal contained therein to said second chamber.

16. The method of claim 12 wherein said first depressurizing stage includes:

delivering pressurized gas from said second chamber to the bottom of said first chamber.

17. The method of claim 2 including means for delivering powdered coal from said first chamber to said second chamber upon depressurization of said second chamber.

18. A method for treating powdered coal comprising the steps of:

(a) storing a volume of powdered coal in a first chamber, the coal being intended for delivery to at least one second chamber;

(b) delivering a gas under pressure to said second chamber to pressurize the coal in said second chamber to deliver to coal to an installation for use;

(c) depressurizing said second chamber by;

(1) a first depressurizing stage wherein said second chamber is connected to said first chamber to discharge pressurized gas in said second chamber through coal in said first chamber and thence through vent means for passing said pressurized gas to atmosphere in said first chamber; and (2) a second depressurizing stage wherein said second chamber is connected to atmosphere via said vent means in said first chamber;

(d) delivering powdered coal from said first chamber to said second chamber when said second chamber is depressurized;

(e) terminating said first depressurizing stage and commencing said second depressurizing stage when the pressure within said second chamber falls to a predetermined value;

(f) subjecting the pressurized gas during said first depressurizing stage to a dynamic filtration phase and a static filtration phase;

wherein said dynamic filtration phase and said static filtration phase each includes a filter; and further including the step of:

purging each of said filters with an inert gas and delivering said inert gas and any powdered coal contained therein to said second chamber.

19. Apparatus for the delivery of powdered coal to an installation for use, including:

a first chamber for storing a first quantity of powdered coal;

at least one second chamber for containing a second quantity of powdered coal, the volume of said second chamber being less than the volume of said first chamber;

inert gas means for pressurizing said second chamber to deliver powdered coal from said second chamber to an installation for use; and depressurizing means for depressurizing said second chamber to enable the delivery to powdered coal from said first chamber to said second chamber, said depressurizing means including:

a first depressurizing circuit connecting said second chamber to said first chamber to discharge pressurized gas from said second chamber through coal in said first chamber and to atmosphere;

a second depressurizing circuit connecting said second chamber to said first chamber to discharge pressurized gas from said second chamber to atmosphere via said first chamber;

filter means for filtering said pressurized gas in said first depressurizing circuit, said filter means including a dynamic filter and a static filter; and means for purging said dynamic filter and said static filter with inert gas and delivering the inert gas and any entrained coal to said second chamber.

* * * * *

UNITED STATES PATENT AND TRADEMARK OFFICE

CERTIFICATE OF CORRECTION

PATENT NO. : 5,284,187
DATED : February 8, 1994
INVENTOR(S) : Louis Schmit

It is certified that error appears in the above-identified patent and that said Letters Patent is hereby corrected as shown below:

Column 3,
Line 3, delete "27," and insert therefor -- 26 --

Column 4,
Line 19, delete the colon ":" and insert therefor a semi-colon -- ; --
Line 20, delete the colon ":" and insert therefor a semi-colon -- ; --

Column 5,
Line 6, delete the colon ":" and insert therefor a semi-colon -- ; --
Line 47, delete the colon ":" and insert therefor a semi-colon -- ; --

Column 6,
Line 45, delete "to" between "deliver" and "coal", and insert therefor -- the --

Signed and Sealed this

First Day of January, 2002

*Attest:*

*Attesting Officer*

JAMES E. ROGAN
*Director of the United States Patent and Trademark Office*